United States Patent [19]

Antosh

[11] 4,143,986

[45] Mar. 13, 1979

[54] REBAR SPLICE

[76] Inventor: Leon A. Antosh, R.R. # 1, Erie, Ill. 61250

[21] Appl. No.: 867,716

[22] Filed: Jan. 9, 1978

[51] Int. Cl.[2] ..... F16B 7/18

[52] U.S. Cl. ..... 403/307; 403/312; 52/726

[58] Field of Search ..... 403/312, 310, 311, 300, 403/284, 285, 279, 305, 282, 307; 52/726

[56] References Cited

U.S. PATENT DOCUMENTS

| | | | |
|---|---|---|---|
| 1,643,110 | 9/1927 | Briggs | 403/284 X |
| 1,806,687 | 5/1931 | Hoover | 403/312 |
| 3,033,600 | 5/1962 | Drysdale | 403/274 |
| 3,633,951 | 1/1972 | Hinkle et al. | 403/284 X |
| 3,737,975 | 6/1973 | McKinnon, Jr. | 52/726 X |
| 3,850,535 | 11/1974 | Howlett et al. | 403/305 |

FOREIGN PATENT DOCUMENTS

| | | | |
|---|---|---|---|
| 177910 | 3/1954 | Austria | 403/312 |

*Primary Examiner*—Andrew V. Kundrat
*Attorney, Agent, or Firm*—Ronald E. Barry

[57] ABSTRACT

A reinforcing rod splice for connecting reinforcing rods in end to end relation including a pair of hollow steel tubes and a coupling or sleeve, the tubes being mounted on the ends of the reinforcing rods. The tubes being deformed on the inner surface to conform to the deformations on the rods and deformed on the outer surface to provide a connection for the coupling or sleeve. The coupling or sleeve having an inner surface conforming to the deformations on the outer surfaces of the tubes.

10 Claims, 6 Drawing Figures

REBAR SPLICE

BACKGROUND OF INVENTION

Reinforcing steel rods are universally used to strengthen concrete. The steel rods are produced in the steel mill by rollers to size the diameter of the rods and also produce a predetermined form of deformation on the outer surface of the rods. These deformations provide the bonding strength of the rod to the concrete when embedded therein. The steel industry has developed standards relative to the strength of reinforcing steel rods and also standards relative to the dimensions of the deformations on the surfaces thereof. However, each steel mill has independently developed deformation specifications which vary the spacing and orientation of the deformations. The spacing and orientations of the deformations therefore provide an indicia for determining the source of the reinforcing rod. In some instances as a result of using various sets of rollers even the same steel mill may have variations in both the spacing and orientation of the deformations while at the same time maintaining the same pattern.

It is also generally known that reinforcing steel rods are placed in a concrete structure in networks which are located at positions dictated by accepted design criteria. When the design criteria dictates that continuity of reinforcing steel is required a number of methods have been developed to meet this criteria. The first method merely involves the selection of a reinforcing rod having the required length. However, economies of production have limited the total length of a single steel rod to approximately sixty feet. The second method is to lap splice two adjoining pieces of reinforcing steel rods. However, a lap splice requires double the space and in areas of very dense reinforcing steel construction there is often not enough space available in relation to the concrete to meet design criteria. This is commonly encountered in columns, walls, piers or other structures that have a rather small volume but require very heavy reinforcing steel rods.

Finally connecting couplings have been developed to directly join two pieces of reinforcing steel rods in an end-to-end relation. Such couplings have taken the form of steel sleeves placed equal distances over both ends of the adjoining reinforcing rods. Molten metal is poured into the spaces defined between the outside of the reinforcing steel rods and the inside of the sleeve in order to bond the sleeve to the rod. Obviously this method is cumbersome and sometimes cannot be relied on to provide the same strength in each coupling. It should be also noted that a fire hazard is always present whenever molten metal must be used to produce a final object.

SUMMARY OF THE INVENTION

The splice, according to the present invention, provides a simple means of connecting reinforcing rods by unskilled labor at the construction site. The splice is adaptable to connect the ends of any two pieces of reinforcing steel rods. The splice will produce full compressive, tensile and bending strength between the reinforcing rods when connected. This is accomplished by placing a hollow steel tube over each end of the two rods to be joined. The hollow steel tube or sleeve is compressed into intimate contact with the steel rod with the inner surface being deformed to the shape of the deformations provided on the outer surface of the steel rod. The outer surface of the tube is also deformed to a predetermined outer configuration to provide a connection with the sleeve. A connecting sleeve is then mounted on the hollow tubing, the connecting sleeve being preformed to conform to the shape of the deformation provided on the outer surface of each of the hollow steel tubes. A single connecting sleeve can be used if the outer surface of the sleeves are provided with a spiral deformation.

DRAWINGS

DESCRIPTION OF THE INVENTION

Figure 1:
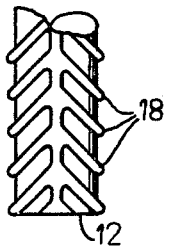
FIG. 1 shows the end of a reinforcing rod having deformations on the outer surface.
Figure 2:
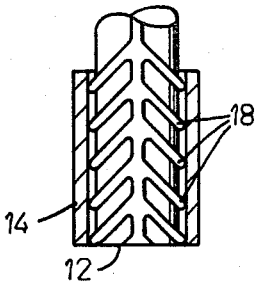
FIG. 2 shows the end of the reinforcing rod with a hollow deformable tube positioned on the end of the rod.

The reinforcing rod connector assembly 10 according to the present invention is used to connect the ends of a pair of reinforcing rods 12. The assembly 10 includes a hollow deformable steel tube 14 provided on the end of each reinforcing rod and means engageable with said tubes for connecting the ends of the steel rods in the form of a connector coupling clamp 16 or a hollow sleeve 19.

More particularly as seen in FIG. 1 each of the steel rods 12 includes a series of pattern deformation 18 on the outer surface. A pattern deformation being conventionally used as the means for bonding the steel rod to the concrete when embedded therein. The deformation 18 will vary depending on the rollers used to size the rods as well as the steel mill where the rods are rolled.

The ends of the reinforcing rods 12 are prepared for splicing by mounting the hollow deformable steel tube 14 on the end of each rod. The hollow steel tube 14 having an internal diameter slightly greater than the outside diameter of the deformation 18. The tube is secured to the end of the reinforcing rod by compressing the tube into the intimate engagement with the outer surface of the end of the reinforcing rod. The inside surface as seen in FIG. 3 will be deformed to the shape of the outer surface of the reinforcing rod to provide full contact with the reinforcing rod throughout the full length of the tube.

Figure 3:
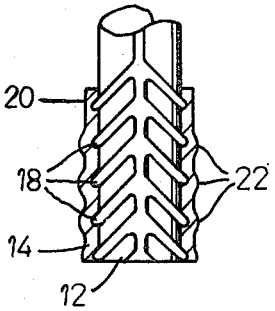
FIG. 3 shows the hollow deformable steel tube compressed and deformed into engagement with the deformations on the outer surface of the rod and the outer surface of the tube being deformed to a desired shape.
Figure 6:
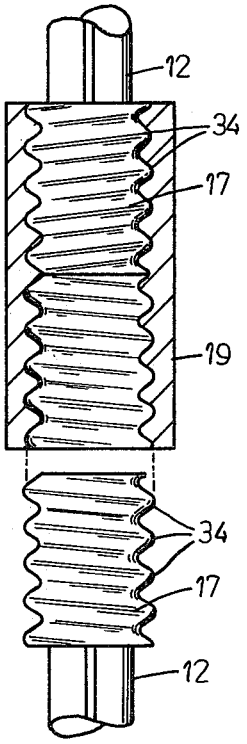
FIG. 6 is a view of a pair of reinforcing rods having hollow steel tubes secured to the end of the rods and having a spiral outer deformation and a single connector having a spiral arrangement conforming to the spiral provided on the hollow steel tubes.

It should be noted in FIG. 3 that the outer surface 20 of the hollow steel tube 14 is also deformed to provide deformation 22 arranged in a predetermined relationship either as circles as seen in FIG. 3 or as a spiral as seen in FIG. 6.

Figure 4:
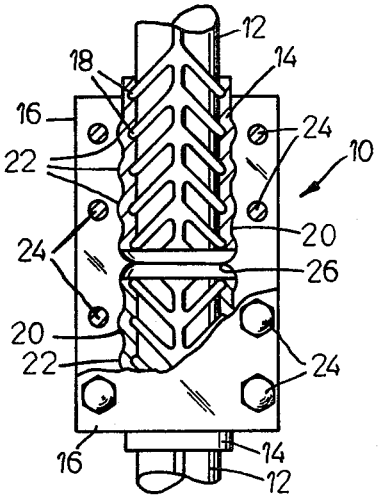
FIG. 4 is a view of the ends of two reinforcing rods having the hollow steel tubes mounted thereon and a two piece connector secured to the ends of the rods.

Referring to FIG. 4 it should be noted that the ends of the rods are connected by means of a two piece coupling 16 having an internal surface conforming to the deformations 22 provided on the outer surface of the hollow steel tube 14. The members of the coupling being held together by means of a number of bolts and nuts.

Referring to FIG. 4 the reinforcing rods 12 are shown in a vertical relationship. In order to provide proper centering of the coupling 16 on the ends of the reinforcing rods a centering rib 26 is provided on the coupling members which will be aligned with the space between the ends of the reinforcing rods.

Figure 5:
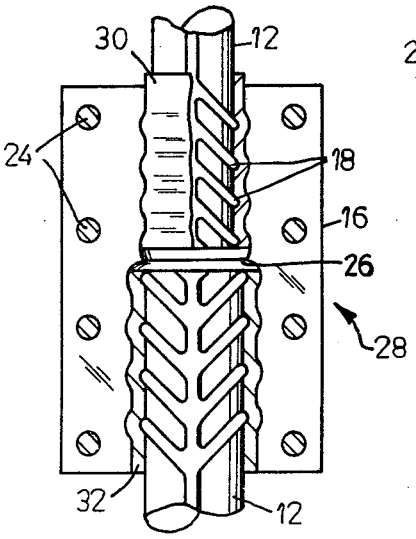
FIG. 5 shows the ends of the two steel reinforcing rods having different diameters and a coupling member mounted on the rods.

Referring to FIG. 5 the connector assembly 28 shown is used to connect the ends of reinforcing rods of different diameters. In this regard it should be noted that each of the reinforcing rods has a deformable sleeve 30, 32 compressed on the end of the reinforcing rods in intimate contact with the outer surface of the reinforcing rods. The outer surface of each of the sleeves being deformed to provide a means for securing the rods to the connector sleeve. The connector assembly 28 having a corresponding inner surface and a centering rib 26.

Referring to FIG. 6 a pair of reinforcing rods 12 are shown having hollow tubes 17 mounted on the ends of the rods 12 with the deformation 34 on the outer surface of the sleeve being in a spiral. In this embodiment the rods are connected by means of a one piece connector sleeve 17. The connector sleeve 19 having a corresponding spiral to the spiral 34 on the outer surface of the sleeve.

The embodiments of the invention in which an exclusive property or privilege is claimed are defined as follows:

1. A connector assembly for connecting the ends of a pair of reinforcing rods having pattern deformations on the outer surfaces of the rods, said assembly including:

a pair of hollow metallic tubes adapted to be mounted on the ends of the rods, and each of said tubes being deformable to conform to the pattern deformations at the end of each of the rods and to provide a predetermined deformation on the outer surface of said tube, means engageable with the deformation on the outside surfaces of said tubes for connecting the rods in end to end relation.

2. The connector assembly according to claim 1 wherein said connecting means comprises a two piece coupling adapted to be clamped onto the outside surface of said tubes.

3. The connector assembly according to claim 1 wherein said connecting means comprises a sleeve having an inside surface conforming to the outside surfaces of said tubes.

4. The connector assembly according to claim 1 wherein said deformation on the outer surface of said tubes is in the form of a spiral and said connecting means comprises a sleeve having a corresponding spiral configuration on the inner surface whereby said sleeve can be screwed onto said rods.

5. The connector assembly according to claim 4 wherein said connecting means comprises a two piece coupling.

6. The connector assembly according to claim 1 wherein the reinforcing rods have different diameters.

7. A splice for connecting reinforcing rods have a series of pattern deformations on the outer surface, said splice comprising:

a steel tube mounted on the end of each of the rods, each tube having an inner surface conforming to the pattern deformation on the end of each rod to intimately engage the deformations on the rods, said tubes having predetermined deformations on the outer surface, and a connecting member mounted on said tubes and having an inner surface corresponding to the deformations on the outer surface of said tubes whereby said rods are secured in end to end relation.

8. The splice according to claim 7 wherein said connecting member comprises a sleeve.

9. The splice according to claim 8 wherein said deformations on the outer surface of said tubes is in the form of a spiral whereby said sleeve can be simultaneously screwed on to each rod.

10. The splice according to claim 1 wherein said connecting member comprises a two piece coupling.

* * * * *